United States Patent [19]

Jones

[11] Patent Number: 4,946,159

[45] Date of Patent: Aug. 7, 1990

[54] MARTIAL ARTS TRAINING DEVICE WITH REACTIVE ARMS

[76] Inventor: Mitchel Jones, 4725 Harding Dr., Beaumont, Tex. 77703

[21] Appl. No.: 288,970

[22] Filed: Dec. 23, 1988

[51] Int. Cl.[5] ..... A63B 69/00

[52] U.S. Cl. ..... 272/76

[58] Field of Search ..... 272/76, 77, 78, 141, 272/142; 16/50; 273/55 R

[56] References Cited

U.S. PATENT DOCUMENTS

| | | | |
|---|---|---|---|
| 3,804,406 | 4/1974 | Viscione | 272/76 |
| 3,888,481 | 6/1975 | Adams et al. | 272/76 |
| 4,073,038 | 2/1978 | Curry et al. | 16/50 |
| 4,387,892 | 6/1983 | Wen | 272/76 |
| 4,749,184 | 6/1988 | Tobin | 272/78 |

*Primary Examiner*—Stephen R. Crow
*Attorney, Agent, or Firm*—Keeling & Associates

[57] ABSTRACT

A martial arts practicing device with reactive limbs comprises a trunk having a padded front trunk section, and a box-like rear trunk section, together with a plurality of reactive limbs which limbs strike at the location of the practitioner of martial arts in reaction to the practitioner striking the front trunk section. The rear trunk section contains a plurality of springs biased against a rigid board member separating the front trunk section from the spring members. Reactive limbs comprise rigid members biased against the board member by spring hinges with flexible limb members attached to the rigid members. The spring hinges together with rigid biasing members cause the rigid limb members to rotate in response to movement of the board member thereby projecting the ends of the connected flexible limb members into a target area immediately in front of the trunk, which target area is the location of the practitioner. The rear trunk section springs return the padded trunk section to its normally biased position after the strike thereby causing the reactive limb to retract from the target area. Adjusting members are provided to adjust the reaction of the reactive limbs.

13 Claims, 3 Drawing Sheets

MARTIAL ARTS TRAINING DEVICE WITH REACTIVE ARMS

BACKGROUND OF THE INVENTION

The present invention relates to the field of martial arts training devices and particularly to the field of martial arts training devices with reactive limb members.

Martial arts training involves, among other things, developing the ability to effectively strike an opponent and at the same time to be aware of and respond to strikes or attempted strikes by the opponent, which strikes may be delivered simultaneously or nearly simultaneously with the strikes delivered. An element of martial arts training involves teaching the student to react to blows from an opponent.

When practicing martial arts with a live opponent blows must be performed at partial speed or pulled to prevent injury to the opponent, as full contact with a live opponent may result in injury. The potential of injury to or from a live opponent exists even though each party attempts to moderate or simulate blows.

It is therefore a common practice in martial arts training schools to practice blows without the benefit of an opponent. A disadvantage of practicing with no opponent is that it is extremely difficult to simulate the presence of an opponent.

Heretofore, there have been attempts to provide reactive apparatus that may be used for martial arts training. Such apparatus include Lebowitz U.S. Pat. No. 4,564,192, which patent provides for simulated limbs as a martial arts training device. However, the device disclosed provides only for thrust to the limbs themselves. No trunk is provided for practice striking and only two (2) limbs are provided. Prince U.S. Pat. No. 4,491,316 discloses an apparatus for practicing defense arts, which apparatus comprises essentially a vertical mast member supporting articles to be struck by the practitioner, and provides no reactive mechanisms. Struss U.S. Pat. No. 4,565,366 discloses a martial arts practice device comprising a padded area and a plurality of piston and cylinder units which by the use of coil springs register the force generated by the punch. Such mechanism provides no reactive components. Wen U.S. Pat. No. 4,387,892 discloses a dummy comprising a trunk and an oscillating mechanism. The dummy is provided with buzzers to indicate when contact is obtained by a practice sword. An oscillating bamboo rod simulating a sword is provided for lateral oscillations between the dummy and the practitioner.

The foregoing inventions and the marital arts training apparatus currently in the market do not provide an effective combination of a target for punching and reactive limbs.

SUMMARY OF THE INVENTION

It is therefore an object of the present invention to provide a martial arts training apparatus with reactive limbs.

It is a further object of the present invention to provide a martial arts training device comprising a trunk-like punching target with reactive limbs that strike at the practitioner's body in reaction to the practitioner striking the trunk.

It is further a purpose of the present invention to provide a martial arts training apparatus with a plurality of reactive limbs that can be adjusted to strike the practitioner's body from a variety of elevations.

It is a further purpose of the present invention to provide a martial arts training apparatus with reactive limbs that are adjustable with respect to timing of reaction.

It is a further object of the present invention to provide a martial arts training apparatus with reactive limbs, which training apparatus simulates the trunk of the human body.

The foregoing objects of the present invention are accomplished by a martial arts practicing device with reactive limbs which comprises a trunk having a padded front trunk section, and a box-like rear trunk section, together with a plurality of reactive limbs which limbs strike at the location of the practitioner of martial arts in reaction to the practitioner striking the front trunk section. The rear trunk section contains a plurality of springs biased against a rigid board member separating the front trunk section from the spring members. Reactive limbs comprise rigid members biased against the board member by spring hinges with flexible limb members attached to the rigid members. The spring hinges together with rigid biasing members cause the rigid limb members to rotate in response to movement of the board member thereby projecting the ends of the connected flexible limb members into a target area immediately in front of the trunk, which target area is the location of the practitioner. The rear trunk section springs return the padded trunk section to its normally biased position after the strike thereby causing the reactive limb to retract from the target area. Adjusting members are provided to adjust the reaction of the reactive limbs.

DETAILED DESCRIPTION OF THE INVENTION

Figure 1:
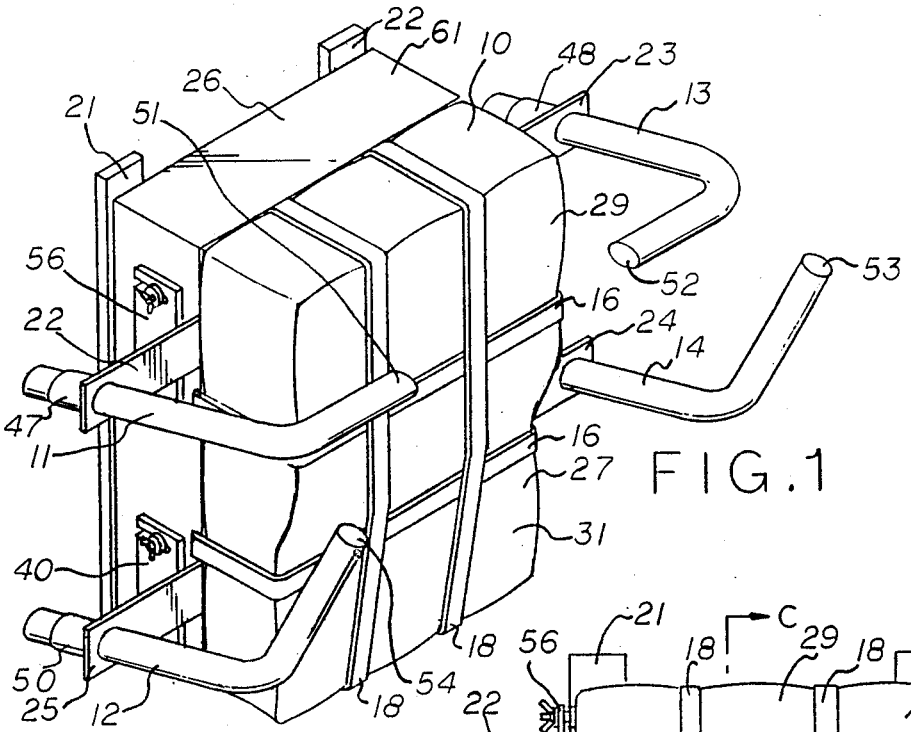
FIG. 1 discloses a perspective view of the apparatus of the present invention.

The martial arts training device 10 of the present invention is depicted in perspective view in FIG. 1 of the drawings. The martial arts training device 10 comprises a front trunk section 27 moveably connected to a fixed rear trunk section 26 and further connected to reactive limb members 11, 12, 13 and 14.

Figure 3:
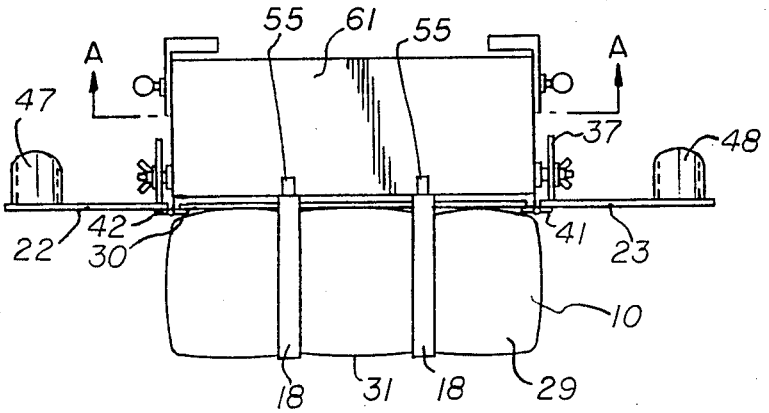
FIG. 3 discloses a top view of the apparatus of the present invention with flexible limb members detached.

Referring to FIG. 3, a box-like rear trunk section 26 is supported by support members 21 and 22. Support members 21 and 22 may be themselves attached to a support surface such as a wall (not shown) or may be provided with a base (not shown) to provide free-standing capability.

Figure 2:
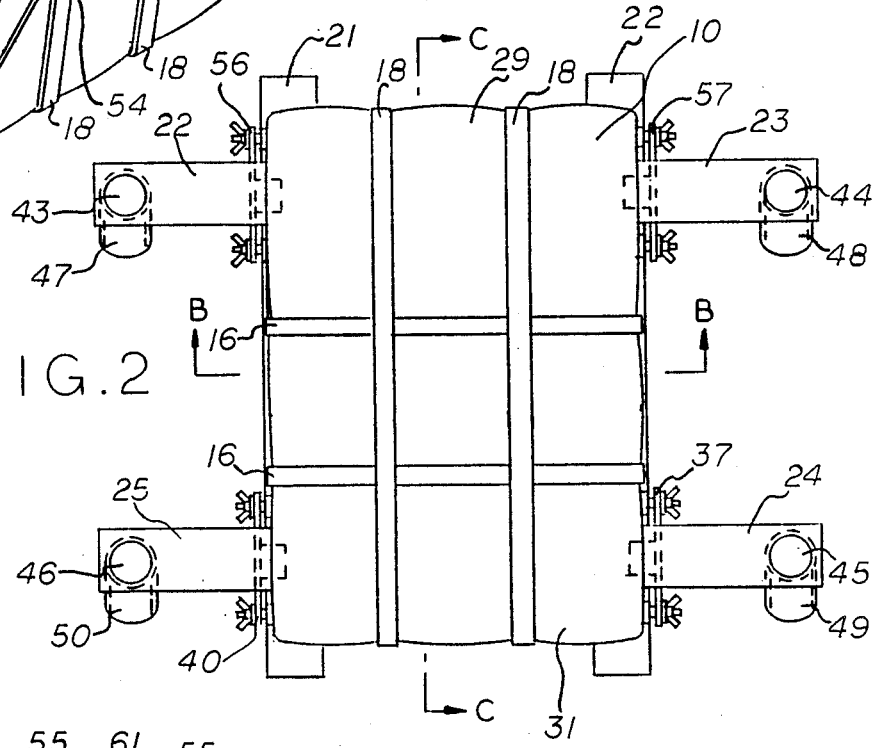
FIG. 2 discloses a frontal view of the apparatus of the present invention with flexible limb members detached.
Figure 6:
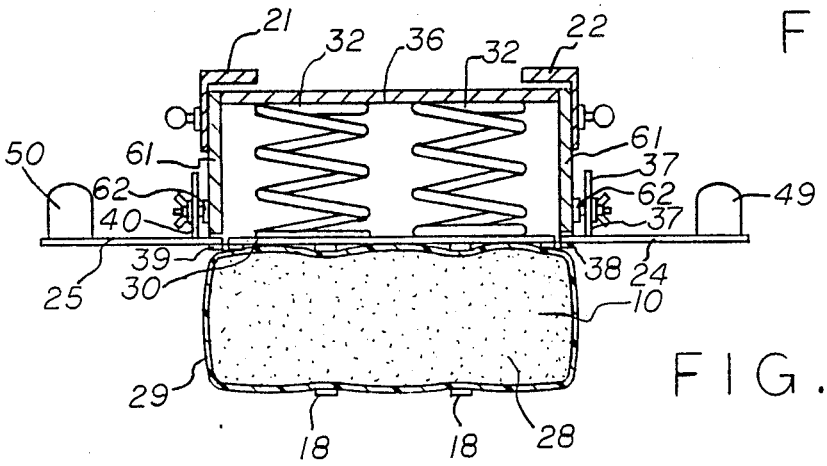
FIG. 6 discloses a cross-sectional view of the apparatus of the present invention along the line B—B of FIG. 2.

Referring to FIGS. 3 and 6, a front trunk section 27 comprises a flexible padding material 28, such as foam rubber, contained within an envelope 29. Envelope 29 is constructed of flexible material such as vinyl fabric. Still referring to FIG. 6 and with additional reference to FIG. 2, lateral straps 16 and vertical straps 18 secure envelope 29 and the padding material 28 contained therein to a rigid board member 30. Board member 30 may be constructed of various materials having rigid properties, including plastic and wood. The length and width of board member 30 is approximately equivalent to the length and width of the padding material 28. Board member 30 is located at the rear of front trunk section 27 and is sized so as to fit between the walls 61 of rear trunk section 26. Front surface 31 of front trunk section 27 comprises the target hitting area for a practitioner of martial arts intending to practice the art.

Figure 4:
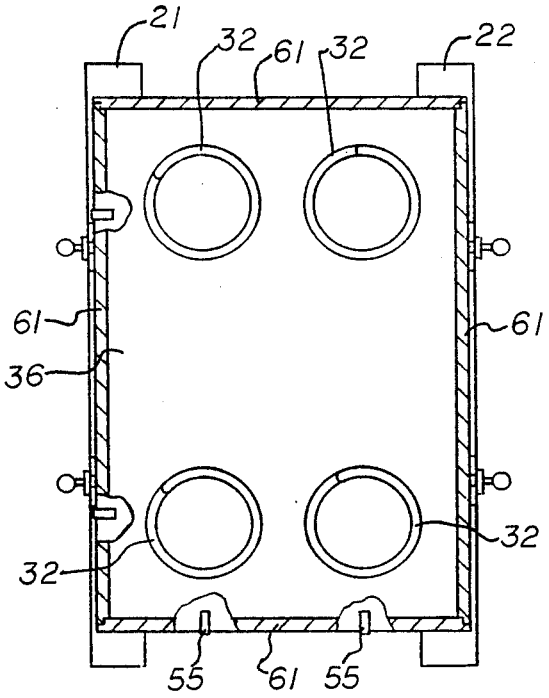
FIG. 4 discloses a cross-sectional view of the apparatus of the present invention along the lines A—A of FIG. 3.
Figure 8:
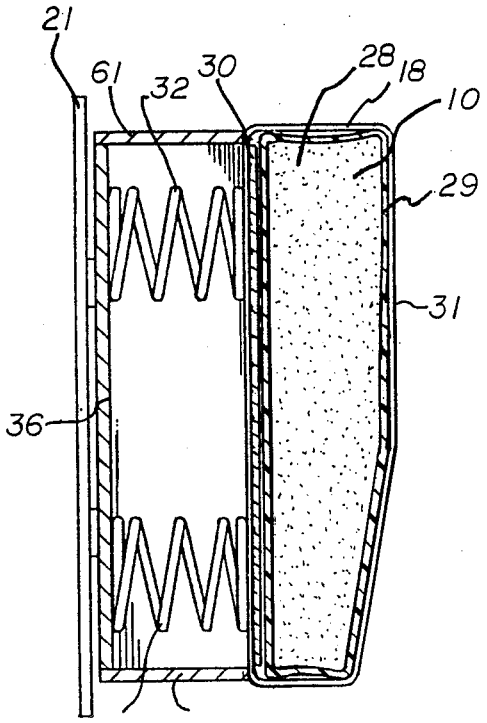
FIG. 8 discloses a cross-sectional view of the present invention along the line C—C of FIG. 2.

Referring to FIGS. 4 and 8, the means of connecting front section 27 to rear trunk section 26 is depicted. A plurality of springs 32 are fastened to the rear surface 36 of rear trunk section 26 such that springs 32 project forward toward front trunk section 27. Springs 32 are so sized as to be compressed by board member 30 upon insertion of board member 30 into rear trunk section 26. A plurality of L-shaped brackets 55 are fastened to the walls 61 of rear trunk section 26 at the ends, of the walls 61 opposite rear surface 36. The projection elongated, vertical sections of L-shaped brackets 55 project past the outer edges of board member 30 thereby restraining board member 30 within the space defined by the walls 61 of box-like rear trunk section 26. Springs 32 therefore bias board member 30 against the projecting elongated, vertical sections of L-shaped brackets. This connecting means provides elastic movement of front trunk section 27 with relation to rear trunk section 26 with spring members 32 continuously asserting compressive forces against board member 30 to bias board member 30 against the elongated, vertical sections of L-shaped brackets 55.

Figure 7:
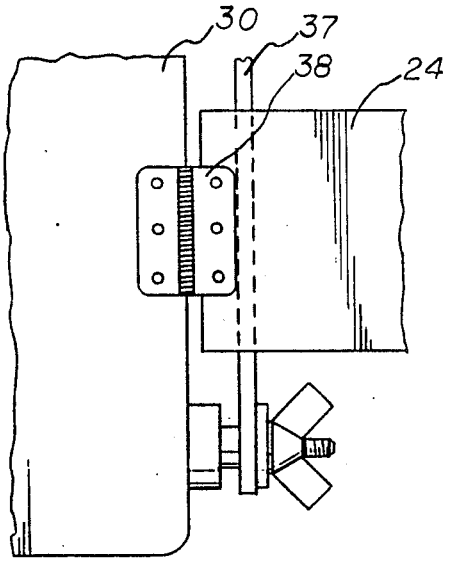
FIG. 7 discloses a frontal detailed view of the connection of a rigid limb member to the board member of the trunk section.
Figure 9:
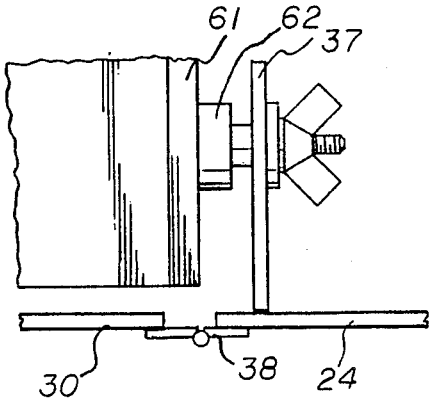
FIG. 9 discloses a top detailed view of the connection of a rigid limb member to the board member of the trunk section.

Referring to FIGS. 1, 2, 3, 5 and 6 it may be seen that rigid limb members 22, 23, 24 and 25 are connected to board member 30 by means of spring hinges 42, 41, 38 and 39. With particular reference to FIGS. 6, 7 and 9, the details of attachment of rigid limb members 22, 23, 24 and 25 to board member 30 may be seen by reference to the detail of connection of rigid limb member 24 to board member 30. Rigid limb member 24 is movably connected to board member 30 by means of spring hinge 38 which spring hinge 38 normally biases rigid limb member 24 in the direction of rear trunk section 26. Adjusting member 37 is fastened to the wall 61 of rear trunk section 26 and extends slightly forward of wall 61. Spring hinge 38 therefore biases rigid limb member 24 against the projecting adjusting member 37. Upon movement of board member 30 in a horizontal direction toward the rear of rear trunk section 26, rigid limb member 24 is propelled in the opposite horizontal direction by means of contact of rigid limb member 24 against adjusting member 37, with the rigid limb member 24 being propelled in an arc about the axis of spring hinge member 38. Rigid limb member 25 is connected to board member 30 in like manner by spring member 39. Rigid members 22 and 23 are similarly connected to board member 30 by spring hinges.

Figure 5:
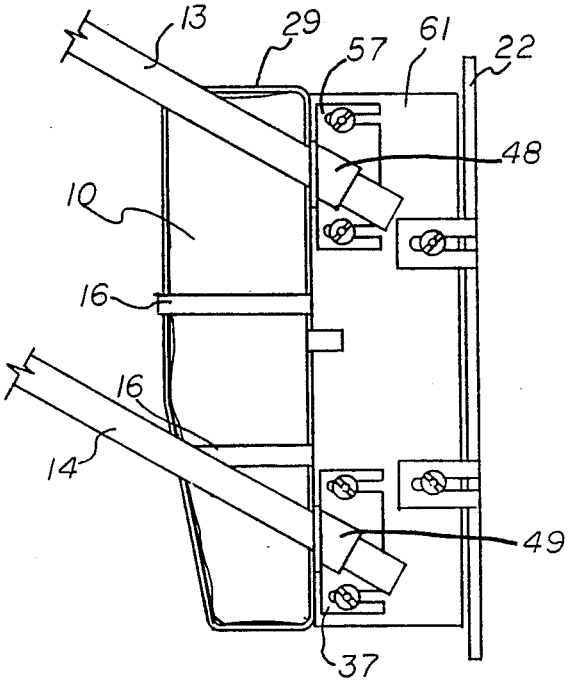
FIG. 5 discloses a side view of the apparatus of the present invention.

Referring to FIG. 5, it may be seen that adjusting member 37 is fastened to the side 61 of rear trunk section 26 by means of bolts and wing nuts. Slots are provided in adjusting member 37 to provide for adjustment of adjusting member 37 in a horizontal direction. By moving the adjusting member in a horizontal direction, the reaction time of the rigid limb member 24 as perceived by the practitioner may be adjusted. By moving adjusting member 37 in the direction of the front trunk section 27, the rigid limb member 24 is biased forward, providing a shorter distance for the limb to travel to reach the area of the practitioner.

Still referring to FIG. 5 it may be seen that adjusting member 37 may be moved closed to side 61 or farther from side 61 by removing or adding washers 62. Addition or deletion of washers 62 varies the distance between adjusting member 37 and the axis of spring hinge 38 thereby varying the speed of reaction of rigid limb member 24 to movement of board member 30.

In like manner, adjusting members 40, 56 and 57 allow for adjustments of the reaction of rigid limb members 25, 23, and 22.

Referring to FIGS. 1, 3, 5 and 6 it may be seen that rigid limb members 22, 23, 24, and 25 are provided with circular holes 43, 44, 45 and 46 and that truncated cylinders 47, 48, 49 and 50 are connected to rigid limb members 22, 23, 24 and 25 at such vertical holes. Truncated cylinders 47, 48, 49 and 50 project from the rear surface of rigid limb members 22, 23, 24 and 25 and in a downward direction. Flexible limb members 11, 12, 13 and 14 are inserted into the circular spaces 43, 44, 45, and 46 and truncated cylinders 47, 48, 49 and 50. Flexible limb members 11, 12, 13 and 14 extend forward toward an area in front of the striking surface 31. Flexible limb members 11, 12, 13 and 14 are preferrably constructed of a flexible material such as polyurethane foam. The diameters of flexible limb members 11, 12, 13 and 14 are so sized as to require that the flexible limb members be compressed by insertion into truncated cylinders 47, 48, 49 and 50, thereby providing fixed attachment of the reactive limbs to the respective truncated cylinders. Flexible members 11, 12, 13 and 14 are formed so that the projecting ends 51, 52, 53 and 54 of the flexible limb members 11, 12, 13 and 14 project towards the area in front of the striking surface 31.

OPERATION OF THE INVENTION

Referring to FIG. 1 the striking surface 31 of front trunk section 27 and the ends 51 and 52 of flexible limb members 11 and 12 define an open area wherein the practitioner (not shown) is located. The practitioner may strike practice blows at the striking surface 31. The flexible padding material 28 of the front trunk section 27 allows the practitioner to strike the striking surface 31 with a great deal of force without injury to the practitioner's hands or feet. Upon striking the striking surface 31 the force of the blow is transmitted to the flexible board member 30 consequently compressing one or more of the various spring members 32. The lateral motion of board member 30 causes the rotation of one or more rigid limb members 22, 23, 24 and 25 about the axis of one or more of the respective connecting spring hinges due to the contravening forces of adjusting members 37, 40, 41 and 42 against the said rigid limb members 22, 23 24 and 25, thereby propelling flexible limb members 12, 13 and/or 14 toward the practitioner.

Upon completion of the blow, springs 32 expand biasing the board member against the projecting els of L-shaped brackets 55 allowing the spring hinges connecting rigid limb members 22, 23, 24 and 25 to return to their normally biased position, thereby causing the limb members 11, 12, 13 and 14 to retract from the location of the practitioner.

Adjustment of the distance to be traveled by the ends 51, 52, 53 and 54 of end members 11, 12, 13 and 14 may be accomplished by moving adjusting members 42, 41, 37 and 40 in a lateral direction with respect to the front and rear of trunk 15. Additionally, the speed of rotation of rigid limb members 22, 23, 24 and 25, and consequently limb members 11, 12, 13 and 14, about the axis of the connecting spring hinges may be adjusted by relative movement of adjusting members 42, 41, 37 and 40 toward or away from the rear trunk section 26. Relative movement of adjusting members 42, 41, 37 and 40 away from rear trunk section 26 increases the distance between the axis of the connecting spring hinges and the contravening force exerted by the adjustable members thereby decreasing speed of reaction.

Various other modifications and embodiments of the foregoing invention may be made without departure from the scope of the invention as set forth in the following claims.

What is claimed is:

1. A device for use in the practice of martial arts wherein blows are struck to a target striking member comprising:

a striking member including a frontal striking surface;

a rigid supporting structure elastically connected to the striking member;

at least one limb member;

at least one hinge mechanism connecting each limb member to the striking member;

the axis of rotation of each hinge mechanism being located between the limb member and the striking member;

spring means provided at each hinge mechanism to normally bias each limb member in a first position;

a rigid member biased against the back side of each limb member;

whereby striking of the striking surface results in backward movement of the striking member with relation to the rigid member resulting in rotational movement of each limb member about the axis of the hinge thereby rotating the limb member in the direction of an area in front of the striking surface.

2. The device according to claim 1 wherein:

the elastic connection means between the striking member and the supporting structure comprises at least one spring biased between the supporting structure and the striking member.

3. The claim according to claim 1 wherein:

the hinge mechanism comprises a spring hinge.

4. The device according to claim 1 wherein:

the striking member comprises a frontal flexible pad attached to a board member.

5. The device according to claim 4 wherein:

the rigid supporting structure comprises a box-like structure open at the end adjoining the striking member with the structure by means of brackets located at the open end of the box-like structure.

6. The device according to claim 1 wherein:

the rigid member biased against the back side of each limb member is fastened to the supporting structure.

7. The device according to claim 6 wherein:

the rigid member biased against the back side of each limb member may be moved relative to the limb member whereby the reaction time of the limb member to movement of the striking member may be adjusted.

8. The device according to claim 1 wherein:

each limb member comprises an inner inflexible limb section connected between the hinge mechanism and an outer flexible limb section.

9. The device according to claim 8 wherein:

the unattached end of the flexible limb section may be adjusted horizontally and vertically.

10. The device according to claim 1 wherein:

movement of the striking member relative to the supporting structure causes the end of the limb member not attached to the striking member to move into a defined target area located in front of the striking member.

11. A device according to claim 1 wherein:

the striking member is shaped generally like a human torso and four limb members are provided at locations approximating the location of human limbs.

12. A device for use in the practice of martial arts wherein blows are struck to a target striking member comprising:

a striking member including a frontal striking surface;

a rigid box-like supporting structure for the striking member;

the striking member comprising a frontal flexible pad attached to a rigid board member;

elastic means connecting the striking member and the supporting structure comprising at least one spring biased between the supporting structure and the striking member;

the rigid box-like supporting structure being open at the end adjoining the striking member with the board member being retained within the space defined by the rigid box-like structure by means of brackets located at the open end of the rigid box-like supporting structure;

at least one limb member;

at least one hinge mechanism connecting each limb member to the striking member;

the axis of rotation of each hinge mechanism being located between the limb member and the striking member;

spring means provided at each hinge mechanism to normally bias each limb member in a first position;

each limb member comprising an inner inflexible limb section connected between the hinge mechanism and an outer flexible limb section;

a rigid member fastened to the support structure and biased against the back side of the rear surface of the inflexible limb section whereby the limb member is caused to rotate about the axis of the hinge mechanism in reaction to movement of the striking member; and striking of the striking surface results in backward movement of the striking member with relation to the rigid member resulting in rotational movement of each limb member about the axis of the hinge mechanism thereby causing the ends of the limb member opposite the striking member to move into a defined target area in front of the striking member.

13. A device according to claim 12 wherein:

the striking member is shaped generally like a human torso and four limb members are provided at locations approximately at the locations of human limbs.

* * * * *